US005184491A

United States Patent [19]

Schittenhelm

[11] Patent Number: 5,184,491

[45] Date of Patent: Feb. 9, 1993

[54] COMBINATION LOCK WITH MOTOR-DRIVEN TUMBLERS

[75] Inventor: Rudolf Schittenhelm, Freiburg, Fed. Rep. of Germany

[73] Assignee: Theodor Kromer GmbH & Co. KG Spezialfabrik Für Sicherheitsschlösser, Umkirch, Fed. Rep. of Germany

[21] Appl. No.: 555,166

[22] Filed: Jul. 19, 1990

[30] Foreign Application Priority Data

Jul. 21, 1989 [DE] Fed. Rep. of Germany ..... 3924227

[51] Int. Cl.[5] ..... E05B 49/00; E05B 17/00

[52] U.S. Cl. ..... 70/278; 70/303 A; 70/333 R; 70/446

[58] Field of Search ..... 70/277-279, 70/275, 218-223, 303 A, 303 R, 333 A, 333 R, 332, 446, 442, 444, 445

[56] References Cited

U.S. PATENT DOCUMENTS

| | | | |
|---|---|---|---|
| 3,797,936 | 3/1974 | Dimitriadis | 70/278 X |
| 3,812,303 | 5/1974 | Gartner | 317/134 |
| 4,073,518 | 2/1978 | Goodwin | 70/279 X |
| 4,125,008 | 11/1978 | Genest et al. | 70/279 |
| 4,148,092 | 4/1979 | Martin | 70/278 X |
| 4,177,657 | 12/1979 | Aydin | 70/278 |
| 4,433,563 | 2/1984 | Wilson | 70/446 |
| 4,457,148 | 7/1984 | Johansson et al. | 70/278 |
| 4,745,784 | 5/1988 | Gartner | 70/303 A X |
| 4,754,625 | 7/1988 | McGourty et al. | 70/278 X |
| 4,803,860 | 2/1989 | Moore | 70/446 |
| 4,831,851 | 5/1989 | Larson | 70/303 A |
| 4,904,984 | 2/1990 | Gartner et al. | 70/333 R X |
| 4,905,490 | 3/1990 | Wilson | 70/446 X |
| 4,956,984 | 9/1990 | Chi-Cheng | 70/279 X |
| 4,967,577 | 11/1990 | Gartner et al. | 70/303 A X |
| 5,017,851 | 5/1991 | Heinzman | 70/446 X |

FOREIGN PATENT DOCUMENTS

| | | | |
|---|---|---|---|
| 2851396 | 6/1980 | Fed. Rep. of Germany . | |
| 3033233 | 4/1982 | Fed. Rep. of Germany . | |
| 3621564 | 1/1987 | Fed. Rep. of Germany . | |
| 3711501 | 10/1988 | Fed. Rep. of Germany . | |
| 3029735 | 3/1989 | Fed. Rep. of Germany . | |
| 3324176 | 3/1989 | Fed. Rep. of Germany . | |
| 88/05221 | 7/1988 | World Int. Prop. O. | 70/446 |

*Primary Examiner*—Michael F. Trettel
*Assistant Examiner*—Suzanne L. Dino
*Attorney, Agent, or Firm*—Peter K. Kontler

[57] ABSTRACT

A combination lock wherein the tumblers can be moved to predetermined positions, preparatory to retraction of the locking bolt from extended position, by an electric motor which is controlled by a microprocessor. The microprocessor receives signals from a keyboard or from a disc and can start the motor for the purpose of aligning the normally scrambled tumblers only in response to reception of a predetermined sequence of signals. A manually operated knob can be coupled to a driver for the tumblers in order to change the positions of the tumblers and/or to move the locking bolt between extended and retracted positions independently of the motor. The microprocessor is programmed to start the motor only in response to reception of a predetermined sequence of signals in accordance with a selected combination.

33 Claims, 5 Drawing Sheets

Fig. 1
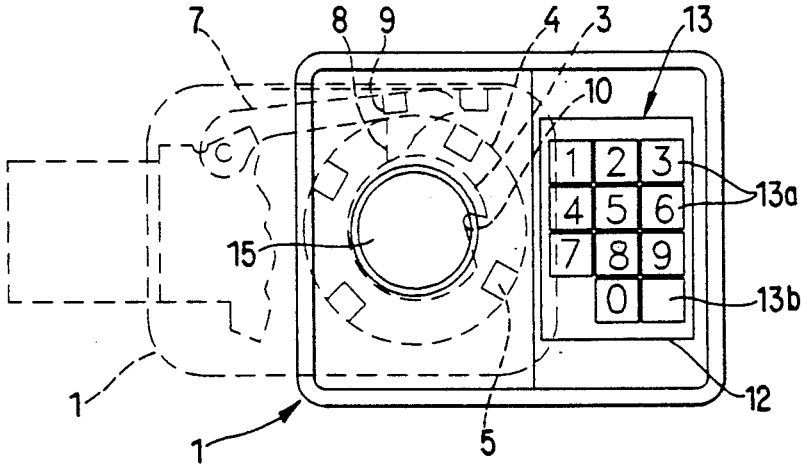
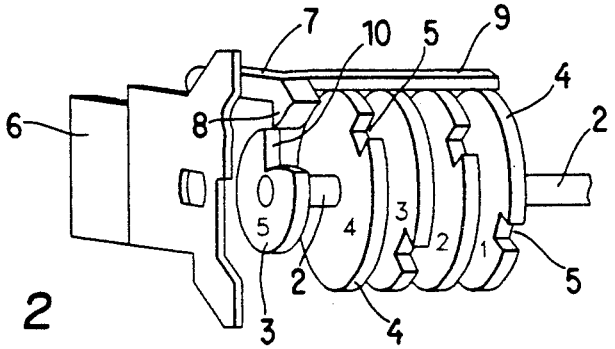
Fig. 2
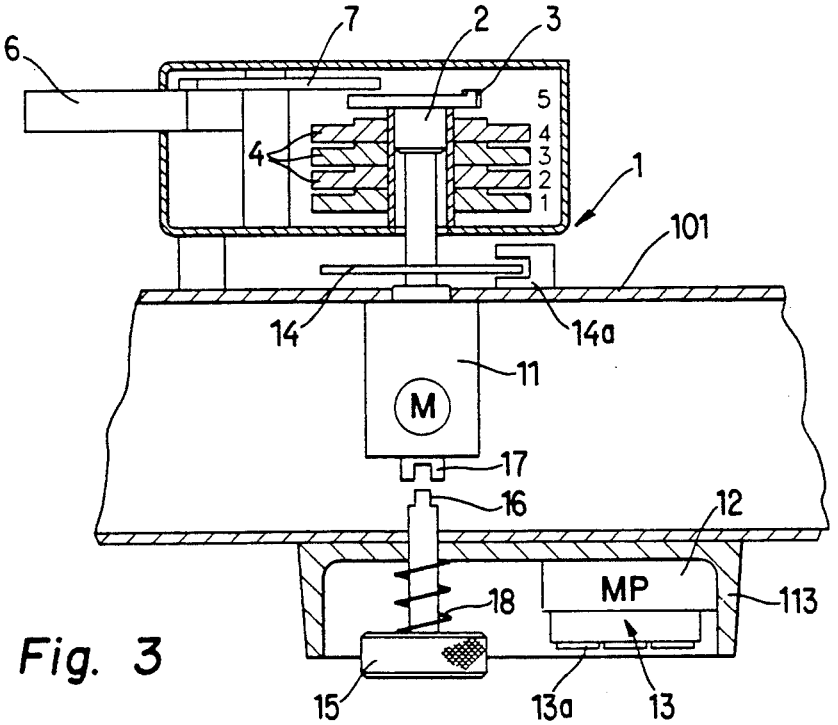
Fig. 3

Fig. 6
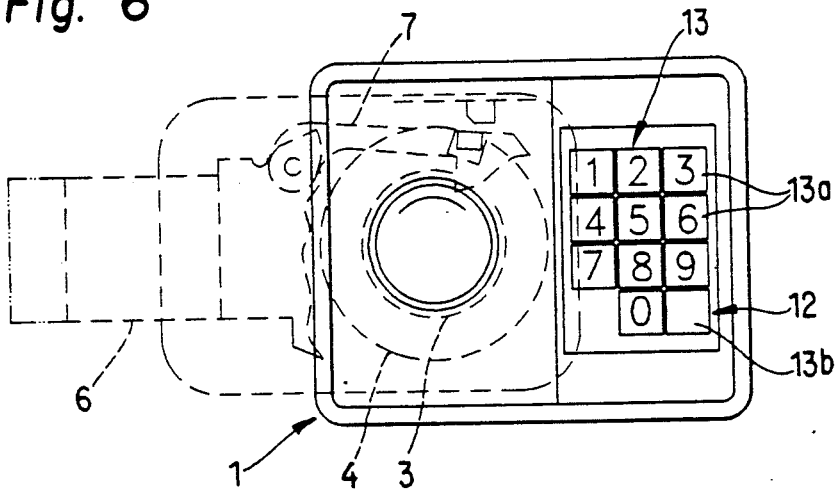
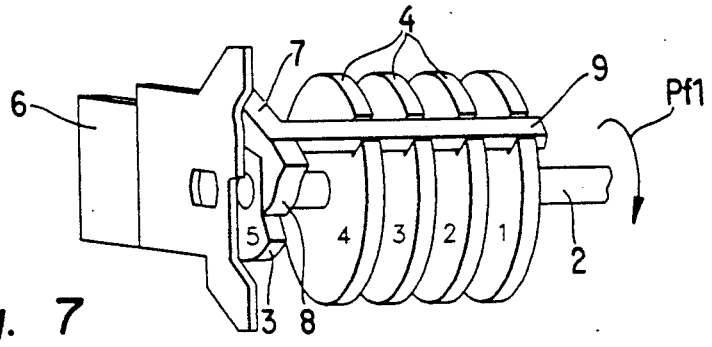
Fig. 7
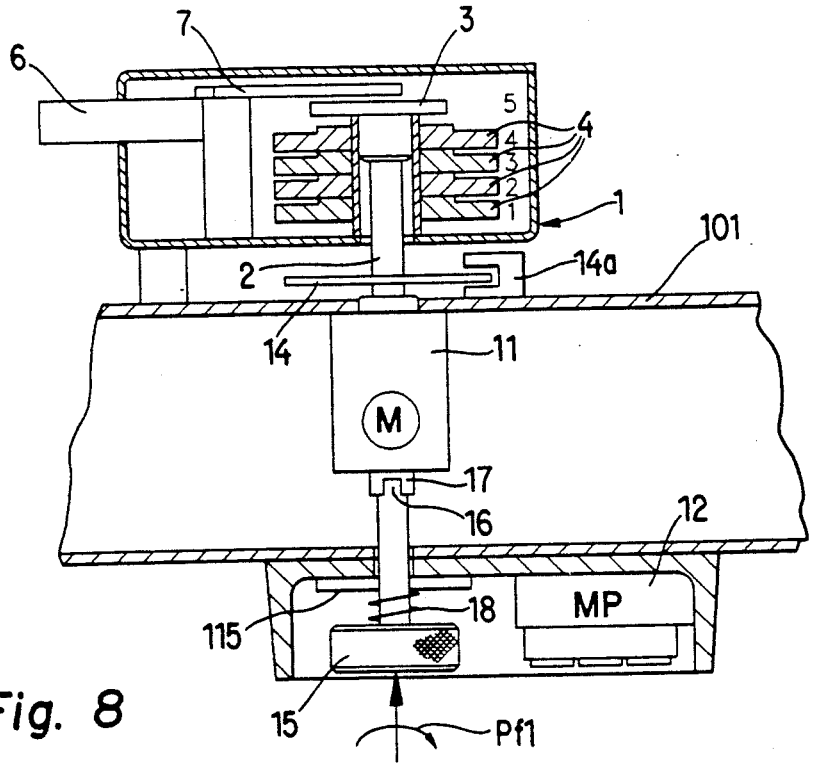
Fig. 8

COMBINATION LOCK WITH MOTOR-DRIVEN TUMBLERS

BACKGROUND OF THE INVENTION

The invention relates to improvements in combination locks of the type known as permutation locks. More particularly, the invention relates to improvements in combination locks of the type wherein two or more tumblers can be rotated and/or otherwise moved to predetermined positions in order to establish the conditions for retraction of a locking hasp or bolt from an extended or operative position to an inoperative or retracted position.

It is already known to provide a combination lock with a set of rotary tumblers which are movable by a rotary knob to and from predetermined angular positions in which a dog of a pivotable link or lever is free to enter peripheral notches of all tumblers and in which a pallet or tooth of the link can enter a cam on the shaft of the knob. Reference may be had to commonly owned German Pat. No. 30 29 735 to Morold. The complexity of manipulations which must be carried out prior to establishment of conditions for retraction of the locking bolt depends upon the number of tumblers and on the complexity of selected combination or code which must be followed in order to move each tumbler to a predetermined position in which the notches of all tumblers are ready to receive the aforementioned dog. The knob which is used to turn the tumblers must be rotated by hand. When the notch-aligning operation is completed and the pallet of the link has entered the recess of the cam. the knob is rotated by hand in order to retract the locking bolt from the extended position. The means for simplifying the task of the operator who is in charge of turning the knob in a clockwise and/or counter-clockwise direction between a number of different angular positions in order to align the notches of all tumblers and to align the recess of the cam with the pallet of the link normally includes a scale which carries a large number of graduations (e.g., graduations numbered from zero to ninety nine). For example, and if the combination lock comprises four rotary tumblers, it is necessary to turn the knob five times in a clockwise direction to select the first digit of a four-digit combination, thereupon four times in a counterclockwise direction to select the second digit of the combination, thereupon three times in a clockwise direction to select the third digit of the combination, and finally twice in a counterclockwise direction to select the fourth digit of the combination. The next step involves clockwise rotation of the knob in order to retract the locking bolt from the extended or operative position.

The carrying out of a total of, for example, fifteen successive angular movements consumes much time. In addition, each turning step must be carried out with utmost care, i.e., the operator must observe the graduated scale in order to ensure that the knob is actually moved to a given position of register with a particular graduation on the scale. Still further, the operator must memorize the sequence and the extent of angular movements of the knob in clockwise and counterclockwise directions, or the operator must continuously refer to a piece of paper or other carrier of information denoting the selected combination. A single minor error (e.g., improper selection of only one of a large number of different angular positions of the knob or rotation of the knob in the wrong direction) renders it necessary to repeat the entire operation with attendant losses in time. It has been found that, as a rule, each successful attempt to open a combination lock with, for example, four tumblers is preceded by at least one unsuccessful attempt and quite often by a series of several successive unsuccessful attempts.

Nevertheless, combination locks which employ a plurality of tumblers are gaining in popularity because they can effectively prevent (or render very difficult) unauthorized opening of doors on vaults, safes and other structures. Moreover, a combination lock can be opened without resorting to a key.

OBJECTS OF THE INVENTION

An object of the invention is to provide a novel and improved combination lock which is constructed and assembled in such a way that it need not be manipulated by hand in order to move its tumblers to predetermined positions in which the locking bolt of the lock is ready for retraction from the operative or extended position.

Another object of the invention is to provide a combination lock which can be opened on the very first attempt as often as desired and by requiring much less attention and carefulness than a conventional lock.

A further object of the invention is to provide a combination lock which can be opened within a minute fraction of the time required for the opening of a conventional lock.

An additional object of the invention is to provide a combination lock which is constructed and assembled in such a way that the angular positions of tumblers are changed in automatic response to return movement of the locking bolt to its extended position and/or under certain other circumstances when the scrambling of tumblers is desirable for the sake of security.

Still another object of the invention is to provide the above outlined combination lock with novel and improved means for unscrambling the tumblers preparatory to retraction of the locking bolt from the extended position.

A further object of the invention is to provide a combination lock which can employ several component parts of conventional combination locks.

Another object of the invention is to provide a combination lock wherein all of the tumblers can be moved to predetermined positions, in which the locking bolt is ready for retraction, within a short or extremely short interval of time irrespective of the overall number of tumblers and irrespective of complexity of the selected combination.

An additional object of the invention is to provide a novel and improved method of converting available combination locks for the purpose of shortening the interval of time which is required to move the tumblers to positions of readiness to permit retraction of the locking bolt from the extended or locking position.

A further object of the invention is to provide a locking bolt which is practically tamper-proof and wherein certain operations or manipulations can be carried out by hand if manual operation is desired or preferred by a particular customer.

SUMMARY OF THE INVENTION

The invention is embodied in a combination lock which comprises a plurality of tumblers movable with reference to each other and/or with each other to and from predetermined positions, a locking bolt which is movable between extended and retracted positions in the predetermined positions of the tumblers, a motor which is operable to move the tumblers to predetermined positions, and programmable means for operating the motor. The operating means can comprise a processor (e.g., a microprocessor or another suitable memory) having at least one signal-transmitting output connected with the motor and at least one data-receiving input, and means (e.g., a keyboard or a dial) for supplying to the input a plurality of sets of data including a predetermined set of data which serve to initiate the transmission of at least one signal by way of the at least one output to operate the motor.

The lock further comprises a driver, particularly a rotary driver, which serves to move the tumblers to and from predetermined positions and receives motion (particularly torque) from the motor.

As mentioned above, the data supplying means of the operating means can comprise a keyboard. However, such data supplying means can also comprise a (preferably indexible) dial or any other suitable device which is or can be actuated by hand to select any one of the aforementioned plural sets of data including the predetermined set of data. The processor of the operating means is or can be programmed to transmit to the motor the at least one signal only in response to reception of a complete predetermined set of data.

The programming of the processor (e.g., by the keyboard) can be such that the processor transmits to the motor the at least one signal only in response to reception of a complete predetermined set of data within a predetermined interval of time.

The lock can further comprise means for monitoring the positions of the tumblers and for transmitting to the processor signals which denote the monitored positions of the tumblers. Each tumbler can be mounted for movement to and from a starting position and to and from a plurality of additional positions including the respective predetermined position. The monitoring means can include an optoelectronic sensor or a battery of such sensors. If the aforementioned driver is designed to move the tumblers about a predetermined axis, the monitoring means can comprise an input member which serves to rotate in synchronism with the driver and a transducer which serves to transmit to the processor signals denoting the angular position of the driver. For example, the input member can comprise a disc or a gear and the transducer can comprise an optoelectronic or inductive signal transmitter.

In accordance with a presently preferred embodiment, the motor can be connected to a casing for the data supplying means.

If the motor is a d-c motor, the lock can further comprise one or more batteries or another suitable energy source for the motor and an enclosure for the tumblers, for the bolt, for the motor and for the energy source. The motor can constitute a stepping motor, and the enclosure can include or constitute a common housing for the tumblers, for the motor and for the energy source.

The output element of the motor can be directly connected with or can include or form part of the aforementioned driver. Alternatively, the lock can comprise a transmission or other suitable means for transmitting motion from the output element of the motor to the driver for the tumblers.

The lock can also comprise detector means (such as the aforementioned sensor) for monitoring the positions of the tumblers and for transmitting to the operating means signals which denote the positions of the tumblers. The detector means can include an input member on the output element of the motor.

The lock can further comprise means for rotating the driver for the tumblers independently of the motor. The rotating means can comprise a manually rotatable actuator and a disengageable clutch between the actuator and the driver. The clutch can comprise a first clutch element on the driver and a complementary second clutch element on the actuator, and the latter is preferably movable axially between a first position in which the second clutch element engages and can transmit torque to the first clutch element, and a second position in which the second clutch element is disengaged from the first clutch element. Means (e.g., a coil spring) can be provided for yieldably biasing the actuator to the second position in which the clutch is disengaged. Alternatively, the lock can comprise a slip clutch which replaces the aforementioned engageable and disengageable clutch or a freewheel which is interposed between the actuator and the driver.

Each set of data can include a set of discrete data (e.g., a sequence of digits, letters or other symbols). The data supplying means of the operating means can include means for furnishing information denoting completion of transmission of successive discrete data of the predetermined set of data.

It is also possible to employ data supplying means which comprises a reader of information serving to initiate the transmission of the at least one signal from the processor to the motor in response to presentation of predetermined information which is stored on a card or the like. This ensures that the operator of the lock need not memorize the predetermined set of data as long as such person is in the possession of a card or a like device which is presented to the reader of the data supplying means, and such presentation of the card to the reader entails the transmission of one or more signals from the output of the processor to the motor which proceeds to move the tumblers to predetermined positions.

The aforementioned detector means or the processor can be designed to generate a signal in response to movement of all tumblers to the respective predetermined positions. The lock can also comprise means for generating signals in response to movement of the bolt to at least one of its extended and retracted positions.

The processor of the operating means can be programmed to operate the motor in response to movement of the bolt to extended position in order to move at least one of the tumblers from the respective predetermined position, i.e., to ensure that the bolt can be retracted only in response to renewed transmission of the predetermined set of data to the at least one input of the processor.

The aforementioned actuator can include a knob which is rotatable by hand to move the tumblers independently of the motor. Means (e.g., a suitable scale) can be provided to indicate the angular positions of the knob.

The data supplying means of the operating means for the motor can be mounted on the actuator; this entails savings in space.

The sensor means which monitors the position of the bolt can be used to generate signals which serve to actuate the operating means for the motor so that the motor is operated to move at least one of the tumblers from the respective predetermined position within a preselected interval of time following the operation of the motor to move the tumblers to their predetermined positions when the signals from the sensor means indicate that the bolt remains in the extended position during the aforementioned interval of time. The operating means can include a timer which is embodied in or is connected to the processor.

The novel features which are considered as characteristic of the invention are set forth in particular in the appended claims. The improved combination lock itself, however, both as to its construction and its mode of operation, together with additional features and advantages thereof, will be best understood upon perusal of the following detailed description of certain presently preferred specific embodiments with reference to the accompanying drawing.

BRIEF DESCRIPTION OF THE DRAWING

FIG. 1 is a schematic front elevational view of a combination lock which embodies one form of the invention and wherein the keyboard of the means for operating the motor is adjacent a manually rotatable knob which can be used to retract the locking bolt from extended position, the housing or casing for the tumblers and the locking bolt being indicated by broken lines;

FIG. 2 is a fragmentary perspective view of certain component parts of the lock, with the tumblers scrambled so that they prevent retraction of the locking bolt;

FIG. 3 is a horizontal sectional view of the lock which is shown in FIG. 1, the bolt being shown in the extended position and the actuator being disengaged from the driver for the tumblers;

FIG. 6 is a front elevational view similar to that of FIG. 1 or 4 but showing the bolt in retracted position;

FIG. 7 is a perspective view similar to that of FIGS. 2 and 5 but showing the bolt in retracted position as a result of clockwise rotation of the driver for the tumblers;

FIG. 8 is a horizontal sectional view similar to that of FIG. 3 but showing the actuator in operative or depressed position in which the actuator can turn the driver for the tumblers in order to move the bolt between extended and retracted positions;

DESCRIPTION OF PREFERRED EMBODIMENTS

Figure 4:
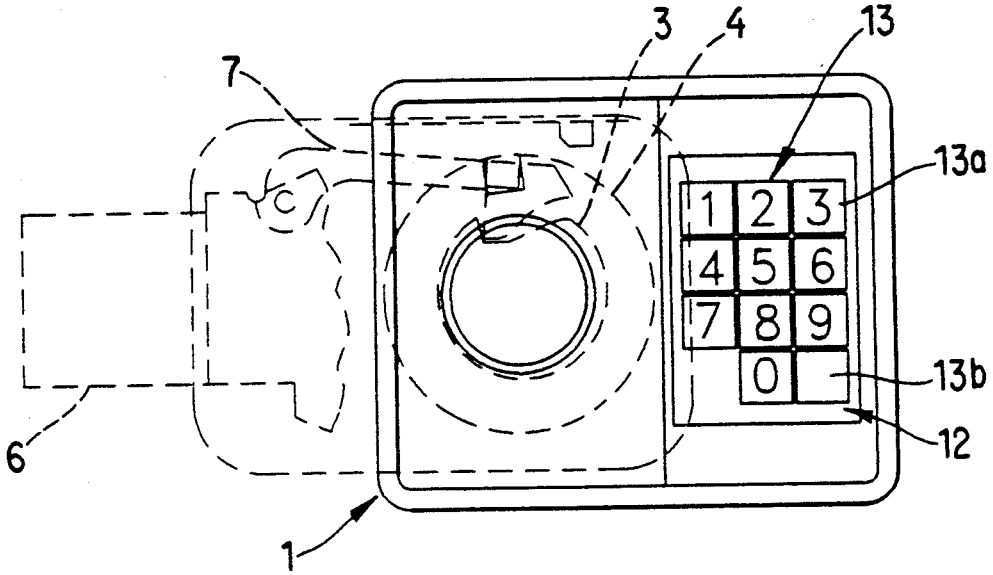
FIG. 4 is a front elevational view similar to that of FIG. 1 but showing the tumblers in positions of alignment preparatory to retraction of the bolt.

Referring first to FIGS. 1 to 8 and 12, there is shown a combination lock 1 of the type known as permutation lock The improved lock 1 comprises a rotary driver including a shaft 2 and a disc cam 3, and a set of four disc-shaped tumblers 4 which are coaxial with and surround the shaft 2. Each tumbler 4 has a peripheral notch 5 which can receive a portion of an elongated dog 9 but only when all of the tumblers assume predetermined angular positions (FIGS. 4 to 7). The number of tumblers 4 can be increased above or reduced to less than four. The lock 1 further comprises a reciprocable locking bolt or hasp 6 which is coupled to a pivotable link 7 carrying the aforementioned dog 9 and further having a pallet or tooth 8 receivable in a recess or tooth space 10 provided in the peripheral surface of the cam 3. The dog 9 extends in parallelism with the axis of the shaft 2, and the bolt 6 is reciprocable between an extended or locking position (see, for example, FIGS. 1 to 4) and a retracted or inoperative position only when the pallet 8 of the link 7 extends into the recess 10 of the cam 3. The manner in which the tumblers 4 can be rotated by the shaft 2 of the driver is known in the art and will not be described here.

Figure 5:
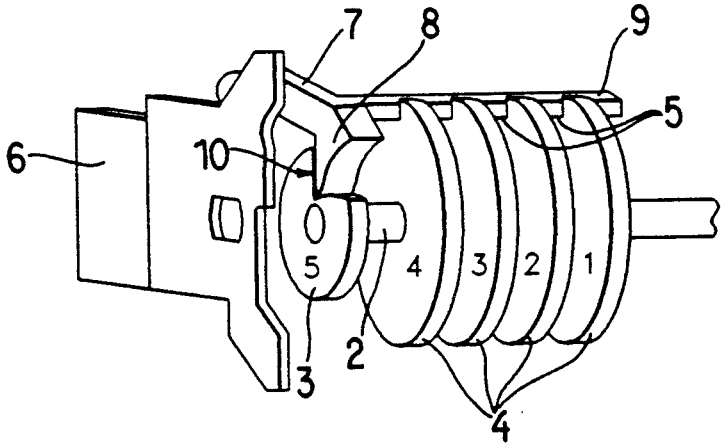
FIG. 5 is a perspective view similar to that of FIG. 2 but showing the tumblers in positions of alignment in which the tumblers permit retraction of the bolt.

FIG. 5 shows each of the four tumblers 4 in the respective predetermined angular position and the pallet 8 of the link 7 in the recess 10 of the cam 3, i.e., the dog 9 extends into the notches 5 of all four tumblers. If the shaft 2 of the driver including this shaft and the cam 3 is thereupon rotated, the cam 3 entrains the link 7 and the latter entrains the bolt 6 so that the bolt leaves the extended position of FIGS. 1 to 5 and moves toward the retracted position of FIGS. 6 to 8. This enables the person in charge of manipulating the lock 1 to open the door of a safe or the like while the bolt 6 is maintained in the retracted position. The lock 1 further comprises means (e.g., an electric motor 11 and the driver 2, 3) for moving the bolt 6 from the retracted position of FIGS. 6 to 8 back to the extended position of FIGS. 1 to 5.

In accordance with a feature of the invention, the improved lock 1 further comprises the aforementioned electric motor 11 (shown in FIGS. 3, 8 and 12) which can be operated to rotate the driver 2, 3 in order to move the tumblers 4 between a large number of angular positions including the predetermined angular positions which are shown in FIGS. 5 and 7. The output element of the motor 11 can constitute or can be separably coupled to the shaft 2, i.e., the motor 11 can be permanently or temporarily connected with the driver for the tumblers 4. In either event, the motor 11 can be said to constitute a permanent part of the improved combination lock 1.

Figure 12:
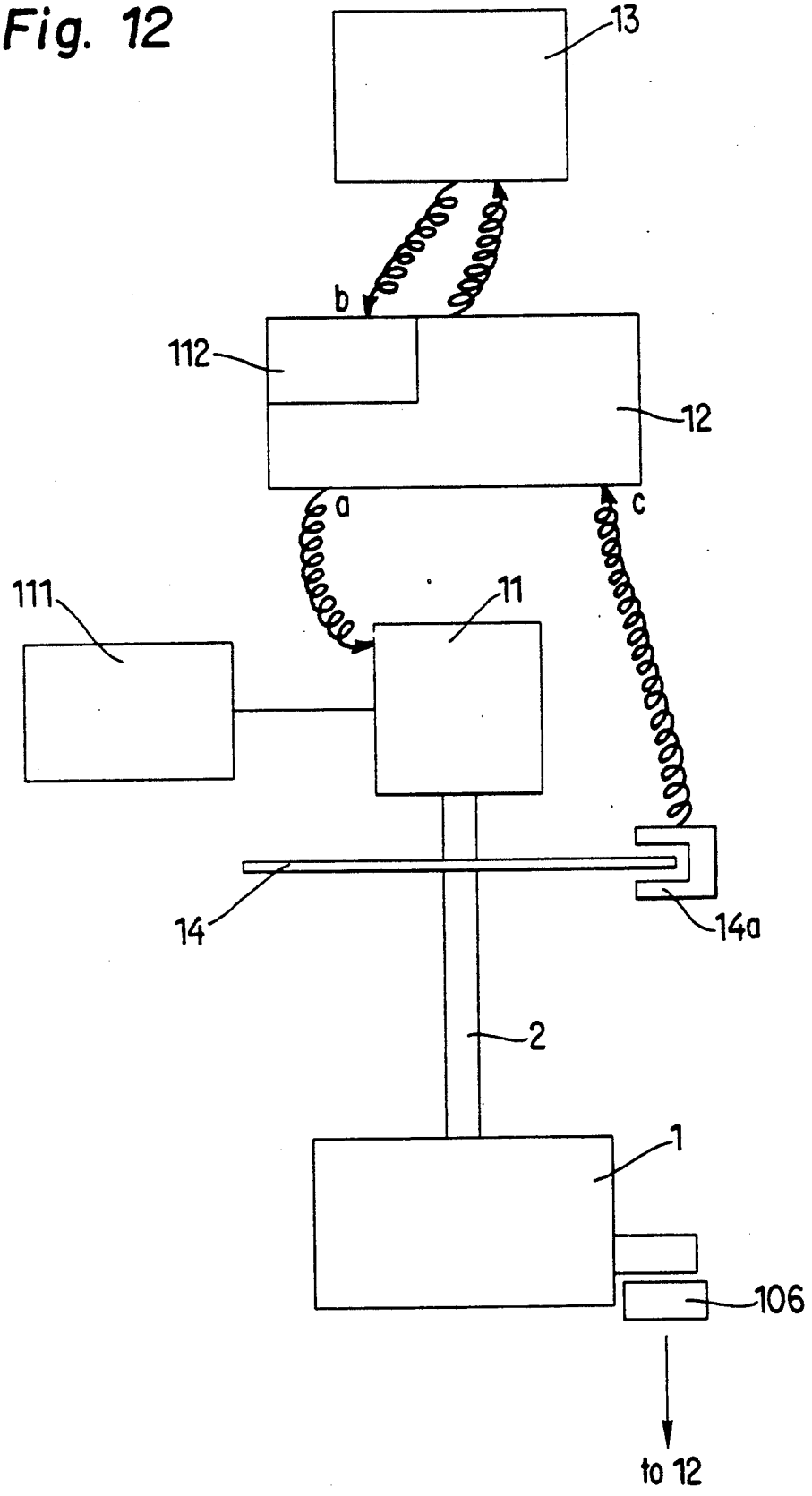
FIG. 12 is a circuit diagram of the improved combination lock and further shows a portable energy source for the motor and for other current-consuming parts of the lock and a timer which is combined with the processor of the means for operating the motor.

The programmable means for operating the motor 11 for the purpose of rotating the tumblers 4 to the predetermined angular positions includes an assembly which is shown in FIGS. 3, 8 and 12 and, in this embodiment of the lock 1, is composed of a microprocessor 12 and a keyboard 13 which latter constitutes a means for supplying to the input b of the microprocessor a plurality of sets of data including a single predetermined set of discrete data enabling the output a of the microprocessor to transmit to the motor 11 one or more signals which set the motor in operation for the purpose of moving all four tumblers 4 to the predetermined angular positions of FIG. 5. As shown in FIGS. 4 to 6, the keyboard 13 can comprise a total of ten independently depressible keys 13*a* numbered "0" to "9", and the motor 11 is set in operation only when the person in charge of manipulating the lock 1 is familiar with the code or combination so that such person can cause the keyboard 13 to transmit to the input b of the processor 12 a predetermined set of data which ensure that the output a of the processor transmits to the motor 11 one or more signals which set the motor in operation for the purpose of moving all four tumblers 4 to the predetermined positions of FIG. 5 in which the dog 9 can enter all four notches 5 and, therefore, the pallet 8 of the link 7 can enter the recess 10 of the cam 3. The keyboard 13 has a casing 113 which can support the motor 11.

The microprocessor 12 is programmed in such a way that it transmits to the motor 11 one or more signals (which are necessary to set the motor in operation for the purpose of moving all four tumblers 4 and the cam 3 to the positions shown in FIG. 5) only if the microprocessor receives a complete set of predetermined data (from the keyboard 13) and preferably only if such complete set of predetermined data is received within a preselected interval of time. If the transmission of a complete set of predetermined data from the keyboard 13 to the microprocessor 12 is not completed within such preselected or predetermined interval of time, the microprocessor fails to react, even if it eventually receives a complete set of predetermined data, and it is then necessary to start all over again, i.e., the person in charge must depress a selected number of keys 13*a* in a predetermined sequence and within the preselected interval of time in order to set the motor 11 in operation in a sense to move all four tumblers 4 and the cam 3 to the positions which are shown in FIG. 5. FIG. 12 shows that the microprocessor 12 comprises or is combined with a timer 112 serving to monitor the length of the interval which elapses after the transmission to input b of a first signal. The timer 112 prevents the microprocessor 12 from accepting any additional signals if the transmission of all signals which are necessary to complete the transmission of a single predetermined set of data enabling the microprocessor 12 to start the motor 11 is not completed within the preselected interval of time. The provision of the timer 112 constitutes a precautionary undertaking which ensures that only a person knowing the selected combination or having information (e.g., a card) pertaining to the selected combination is in a position to initiate the operation of the motor 11 in a sense and for the purpose of moving the tumblers 4 and the cam 3 to the positions of FIG. 5.

When the motor 11 receives the aforediscussed predetermined set of data, it is set in operation to rotate the shaft 2 in clockwise and counterclockwise directions in a predetermined sequence and through predetermined angles which are necessary to align all four notches 5 and to move the cam 3 to the position in which its recess 10 can receive the pallet 8 of the link 7. As a rule, the motor 11 is a reversible electric motor which can be operated to turn the shaft 2 stepwise or continuously through predetermined angles in clockwise and counterclockwise directions as often as is necessary to ensure that the bolt 6 can be retracted in response to further rotation of the shaft 2 by the motor 11 or by an actuator 15 while the pallet 8 extends into the recess 10 and the dog 9 extends into all four notches 5.

It is often preferred to construct the lock 1 in such a way that retraction of the bolt 6 from the extended position is effected by hand, such as by the aforementioned actuator 15, rather than by the motor 11. However, it is equally within the purview of the invention to program the microprocessor 12 in such a way that the motor 11 receives a signal to turn the shaft 2 in a direction to move the bolt 6 from the extended to the retracted position as soon as the cam 3, the link 7 with its pallet 10 and dog 9, and the tumblers 4 assume the positions which are shown in FIG. 5.

It is clear that the keys 13*a* of the keyboard 13 need not necessarily be identified by numerals, i.e., it is equally possible to identify one or more or all of the keys 13*a* with letters and/or other symbols All that counts is to ensure that the keyboard 13 can present a large number of different combinations only one of which is proper to initiate operation of the motor 11 by way of the microprocessor 12. The keyboard 13 can be replaced with other suitable data supplying means, e.g., with a dial disc which can be moved to a plurality of predetermined angular positions in a predetermined sequence in order to enable the microprocessor 12 to receive a predetermined set of data so that the properly programmed microprocessor then initiates the operation of the motor 11 in a manner and for the purpose of moving the tumblers 4 and the cam 3 to the positions of FIG. 5. Irrespective of the exact nature of data supplying means, the operating means including the microprocessor 12 or another suitable memory enhances the simplicity of manipulation of the lock 1 and practically eliminates the possibility of accidental selection of a predetermined set of data by an unauthorized person.

FIGS. 3, 8 and 12 further show that the improved lock 1 can comprise signal generating sensor or detector means for monitoring the angular positions of the tumblers 4 and cam 3, preferably by monitoring the angular position of the shaft 2. The illustrated monitoring means comprises a pulse generating disc-shaped input member 14 which is or can be mounted on the shaft 2 (or on the output element of the motor 11 if such output element is a discrete part other than the shaft 2), and an optoelectronic or other suitable output member or transducer 14*a* (e.g., a bifurcated photocell which straddles a portion of the disc 14 and is connected with a further input c of the microprocessor 12). The monitoring means 14, 14*a* is preferably designed to transmit to the microprocessor 12 signals denoting predetermined starting positions as well those positions of the tumblers 4 which are shown in FIG. 5. The disc 14 need not be mounted on the shaft 2 or on the output element of the motor 11; for example, it is possible to provide a further shaft which carries the disc 14 and receives torque from the shaft 2 so that its angular position changes in synchronism with changes of angular positions of the tumblers 4.

The novel combination of parts 11, 12, 13, 14, 14*a* can be installed in or assembled with available combination locks in order to simplify the manipulation of such locks because, instead of manually turning the tumblers 4 back and forth through preselected angles and predetermined numbers of time, the person in charge only selects a proper combination in order to ensure that the motor 11 is set in operation and moves the tumblers 4 and the cam 3 to the positions which are shown in FIG. 5. The interval of time which is required to open the combination lock is reduced to a fraction of the interval which is required if the tumblers and the cam are to be turned by hand.

The motor 11 can constitute a stepping motor and is preferably a d-c motor so that it need not be connected to an a-c outlet or a similar energy source. For example, the motor 11 can receive energy from a battery 111 or from a group of batteries which are confined in an envelope or enclosure 101, e.g., a housing for the bolt 6, driver 2, 3, tumblers 4, motor 11 and operating means 12, 13. This ensures that it is not necessary to rely on elongated wires or other elongated conductors to connect the motor 11 with the energy source; at the very least, the conductors can be completely confined in the enclosure 101. The enclosure 101 can be modified so as to confine the monitoring means 14, 14*a* on and at the shaft 2 between the motor 11 and the tumblers 4. It is also possible to install the energy source 111 in the door of a safe or vault so that it is not accessible to unauthorized persons.

If it is not necessary or critical to conceal the motor 11 (i.e., to prevent an unauthorized person from gaining access to the motor), the motor can be mounted on the casing 113 of the keyboard 13 at the outer side of a door which normally prevents access to the contents of a safe, a vault or an analogous structure. Such mounting of the motor 11 contributes to simplicity of the lock 1 and to accessibility of the output element of the motor if such output element is to be rotated by the actuator 15 or by a like manually operable component. Moreover, and if the energy source 111 is placed next to the accessible motor 11, the length of electrical connections between the energy source and the motor can be reduced to a minimum.

The utilization of a transmission (not shown) between the output element of the motor 11 and the driver 2, 3 for the tumblers 4 is desirable and advantageous if the space which is available for installation of the improved lock 1 does not permit placing of the motor 11 into immediate or close proximity to the tumblers 4 and their driver 2, 3. Furthermore, a transmission will be used if the designer of the lock wishes to conceal the exact location of the tumblers 4 and of their driver 2, 3 by installing the motor 11 at a certain distance from the shaft 2. The illustrated feature that the shaft 2 of the driver for the tumblers 4 constitutes the output element of the motor 11 contributes to simplicity and compactness of the improved combination lock. In fact, the dimensions of the improved combination lock need not exceed those of a conventional lock wherein the tumblers can be moved solely by manually operated mechanical means.

The aforementioned actuator 15 includes a manually operable knob which is coaxial with the shaft 2 (the latter is assumed to include or constitute the output element of the motor 11) and is movable axially of the shaft 2 between the positions which are shown in FIGS. 3 and 8. One end portion of the shaft 2 carries a female clutch element 17 which can be engaged by a male clutch element 16 on the adjacent end portion of the knob when the latter is moved to the position of FIG. 8. This enables an operator to manually turn the shaft 2, the cam 3 and one or more tumblers 4 in order to retract the bolt 6 from the position of FIGS. 1 to 5 to the position of FIG. 7 (by turning the shaft 2 in the direction of arrow Pfl). The knob of the actuator 15 can also serve to move the bolt 6 back to the extended or operative position as well as to scramble the tumblers 4 when the return movement of the bolt 6 to the operative or extended position is completed.

The lock 1 preferably further comprises a coil spring 18 or other suitable means for yieldably biasing the knob of the actuator 15 to the position of FIG. 3 in which the axially movable clutch element 16 is disengaged from the complementary clutch element 17. In other words, the actuator 15 automatically reassumes its inoperative position, in which it does not interfere with rotation of the shaft 2 by the motor 11, as soon as the spring 18 is permitted to dissipate energy.

The disengageable clutch including the clutch elements 16, 17 can be replaced with a slip clutch or with a freewheel without departing from the spirit of the invention. The arrangement is then such that the slip clutch or the freewheel does not interfere with rotation of the shaft 2 by the motor 11 when the latter is set in operation in response to one or more signals which are transmitted by the output a of the microprocessor 12. However, when the person in charge wishes to turn the shaft 2 by hand, i.e., by way of the actuator 15, a suitable locking or coupling mechanism (not specifically shown) is activated to bypass the slip clutch or the freewheel in order to enable the knob of the actuator 15 to turn the shaft 2 and to change the position of the bolt 6 and/or the angular positions of the tumblers 4.

The keyboard 13 or an equivalent means for supplying sets of data to the microprocessor 12 can be provided with an additional key 13*b* or a like part which can be depressed, touched and/or otherwise influenced to furnish information denoting the completion of transmission of discrete data of a predetermined set of data (i.e., the selected combination) to the microprocessor. Actuation of the key 13*b* can serve to activate the timer 112 which enables or prevents the microprocessor 12 to set the motor 11 in operation, depending upon the length of the interval of time which has elapsed between the depression of first and last keys 13*a* which must be depressed in order to transmit to the microprocessor a predetermined set of data. The arrangement may be such that the key 13*b* must be depressed subsequent to actuation of each of a series of keys 13*a* which must be depressed or touched or otherwise influenced in order to transmit to the microprocessor 12 a predetermined set of data necessary to initiate the operation of the motor 11.

The aforediscussed actuator 15 serves an additional purpose. Thus, if the keyboard 13 (or its equivalent), the microprocessor 12 (or its equivalent) and/or the motor 11 is out of commission, an authorized person who knows the combination can turn the tumblers 4 through the medium of the actuator 15 in order to move the tumblers to the angular positions of FIG. 5. It is preferred to provide the lock 1 with a graduated scale 115 (FIG. 8) or other suitable means for facilitating rapid movements of the knob of the actuator 15 to those angular positions which are necessary to move the tumblers 4 to the angular positions of FIG. 5. The scale 115 need not be permanently installed in or on the lock 1; for example, such scale can be in the possession of a repairman who is called to open the lock 1 in the event of damage to the motor 11, to the microprocessor 12 and/or to the keyboard 13, namely when the owner of the lock or an employee or relative of the owner cannot open the lock in the aforedescribed manner by actuating certain keys 13*a* of the keyboard 13 in a predetermined sequence as determined by the selected combination which must be known to the manipulator of the keyboard 13. The repairman temporarily installs the scale 115 in proper position relative to the actuator 15 and, after having been informed of the combination, proceeds to turn the tumblers 4 until they assume the positions which are shown in FIG. 5.

An advantage of the keyboard 13 (or of a disc which can be used in lieu of the keyboard) is that the manipulation of such parts is known to persons dealing with combination locks as well as to persons who are active in many other fields, i.e., it is not necessary to train an authorized person in order to enable such person to open or close the lock. All that is normally necessary is to entrust to such person the combination which enables the person to transmit to the input b of the processor 12 a necessary sequence of data so that the processor can transmit to the motor 11 one or more signals which are required to start the motor for the purpose of moving the tumblers 4 and the cam 3 to the positions of FIG. 5.

The operation of the motor 11 is or can be selected in such a way that this motor begins to move the tumblers 4 to the positions of FIG. 5 following a movement of the tumblers to their starting positions which are detected and signaled to the processor 12 by the monitoring means 14, 14*a*. This ensures that, when a tumbler 4 is moved from the starting position in predetermined directions, in a predetermined sequence and a predetermined number of times, it invariably reaches the predetermined position of FIG. 5.

The disc 14 of the monitoring means 14, 14*a* can constitute a gear with an annulus of small or minute gear teeth. Such gear is mounted on the shaft 2 or on a shaft (not shown) which is driven in synchronism with the shaft 2 and can cooperate with an output member in the form of an inductive transducer which transmits signals to the input c of the microprocessor 12. The exact construction of the means for monitoring the angular positions of the tumblers 4 forms no part of the present invention.

The feature that the disc 14 of the illustrated monitoring means is installed on the shaft 2 between the motor 11 and the tumblers 4 contributes to compactness of the improved combination lock. Moreover, such mounting of the disc 14 facilitates the determination of starting or zero positions of the tumblers 4, i.e., of those positions which the tumblers assume prior to being turned by the motor 11 in response to one or more signals from the microprocessor 12 in order to move the tumblers to the angular positions of FIG. 5. In addition, the angular movements of the illustrated disc 14 are invariably synchronized with those of the tumblers 4 because the disc 14 is mounted directly on the shaft 2.

Figure 9:
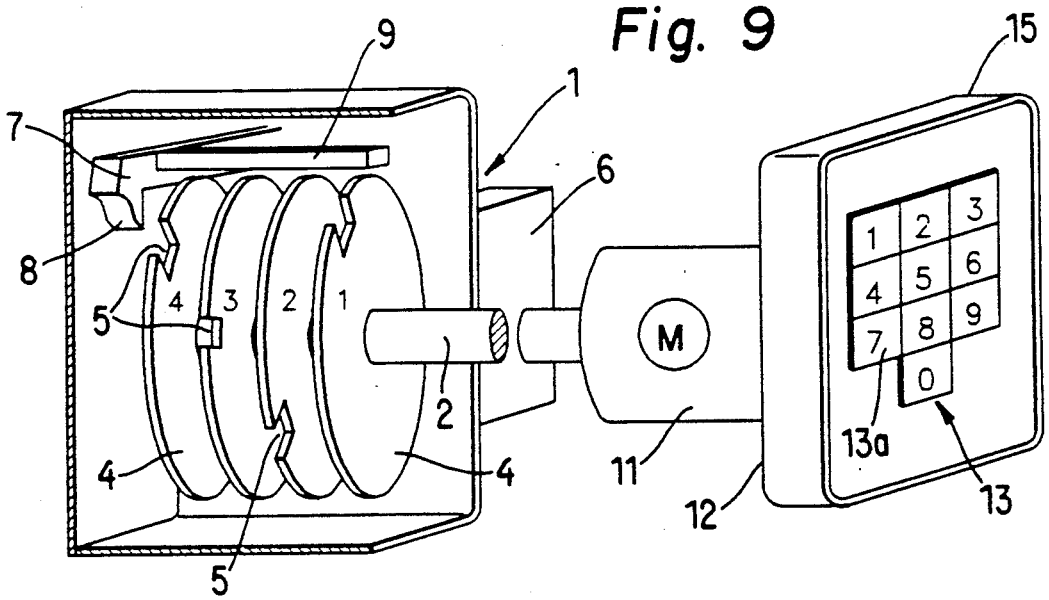
FIG. 9 is an exploded partially sectional view of a modified combination lock wherein the processor and the keyboard are mounted on the actuator and all four tumblers are away from their predetermined angular positions.
Figure 10:
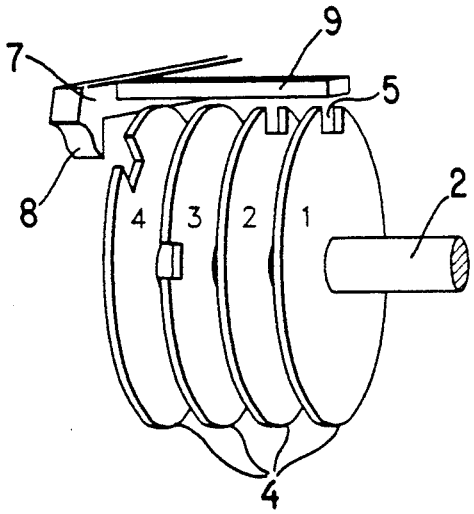
FIG. 10 is a fragmentary perspective view of certain component parts of the modified lock, two of the tumblers being shown in proper positions for engagement by a dog which must enter the peripheral notches of all tumblers before the bolt can be moved from extended position.
Figure 11:
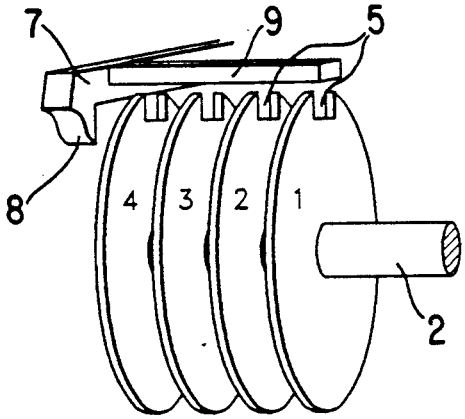
FIG. 11 illustrates the structure of FIG. 10 but with all four tumblers in predetermined angular positions in which their peripheral notches are ready to receive the dog preparatory to movement of the bolt from the extended position.

An important difference between the lock 1 of FIGS. 1 to 8 and 12 on the one hand, and the lock of FIGS. 9 to 11 on the other hand, is that the keyboard 13 and the microprocessor 12 of the operating means for the motor 11 which is shown in FIG. 9 are mounted directly on (and can be said to constitute) the actuator 15. All such parts of the lock of FIGS. 9 to 11 which are identical with or clearly analogous to corresponding parts of the lock 1 of FIGS. 1 to 8 and 12 are denoted by similar reference characters.

The operation of the improved lock is as follows:

An authorized person depresses selected knobs 13*a* in a predetermined sequence and/or a predetermined number of times (depending on the selected combination) in order to ensure that the microprocessor 12 receives a predetermined set of data enabling the output a of the microprocessor to transmit one or more signals which set the motor 11 in operation. The motor 11 proceeds to return the tumblers 4 in a predetermined sequence and through predetermined angles (clockwise and/or counterclockwise) until all of the tumblers assume the angular positions which are shown in FIG. 5. The link 7 is then free to move its pallet 8 into the recess 10 of the cam 3, and the dog 9 is free to enter all four notches 5.

The person in charge thereupon depresses the knob of the actuator 15 to the position of FIG. 8 and turns the shaft 2 in the direction of arrow Pfl (FIG. 7) in order to move the bolt 6 from the extended position of FIGS. 1 to 5 to the retracted position of FIG. 7. As mentioned above, the improved lock can be designed in such a way that depression of a selected key 13*a*, or depression of an additional key of the keyboard 13 (after the cam 3 and the tumblers 4 already assume the positions of FIG. 5), sets the motor 11 in operation in a direction to rotate the shaft 2 for the purpose of moving the bolt 6 to the retracted position through the medium of the cam 3 and link 7.

If the lock 1 is to be closed again, the bolt 6 is returned to the extended position in response to turning of the shaft 2 counter to the direction which is indicated by the arrow Pfl, and the shaft 2 is then rotated beyond the position which is necessary to return the bolt 6 to its extended position; such additional rotation of the shaft 2 serves to move one or more tumblers 4 away from their predetermined angular positions, i.e., the tumblers are scrambled to prevent opening of the lock by an unauthorized person. Rotation of the shaft 2 in order to move the bolt 6 back to the extended position and to scramble the angular positions of the tumblers 4 can be effected by the motor 11 or by the actuator 15.

FIG. 5 shows the shaft 2 in an angular position in which the bolt 6 is fully extended and FIG. 7 shows the shaft 2 in an angular position in which the bolt 6 is at least partially retracted.

If desired, the microprocessor 12 can be programmed to automatically initiate a scrambling of the tumblers 4 (i.e., an angular movement of one or more tumblers away from the respective predetermined position) as soon as the return movement of the bolt 6 to its extended position is completed. To this end, the lock can comprise a suitable sensor 106 which is adjacent the path of movement of the bolt 6 and transmits to the microprocessor 12 an appropriate signal as soon as the movement of the bolt 6 back to the extended position is completed. The sensor 106 can include or constitute an optoelectronic or other suitable monitoring device of any known design. This sensor can be omitted if the motor 11 serves as a means to move the bolt 6 back to the extended position; the microprocessor 12 is then simply programmed to set the motor 11 in operation in automatic response to completion of that angular movement of the shaft 2 which is necessary to return the bolt 6 to its extended position. For example, the microprocessor 12 can set the motor 11 in operation so that the motor performs a certain number of angular movements in clockwise and counterclockwise directions, always through a predetermined angle, in order to ensure that the angular positions of the tumblers 4 depart from those predetermined positions which are shown in FIG. 5, i.e., that only a person who is familiar with the combination can cause the motor 11 to return the tumblers to the positions which are shown in FIG. 5. An advantage of the just described programming of the microprocessor 12 is that the operator of the lock need not be concerned with manipulation of the tumblers 4 subsequent to return movement of the bolt 6 to the extended position, i.e., the operator can forget about the safety and reliability of the lock subsequent to return movement of the bolt to the extended position because the microprocessor 12 automatically ensures adequate scrambling of the tumblers 4 by way of the motor 11 and shaft 2 as soon as the bolt reassumes its extended position. In other words, such programming of the microprocessor 12 contributes significantly to security and reliability of the improved lock as well as to simplicity of its manipulation because, if the operation of the lock is fully automated, an authorized person must merely know the combination and the microprocessor 12 takes over as soon as it receives a predetermined set of data from the keyboard 13.

The programming of the microprocessor 12 can be such that, when the timer 112 transmits a signal denoting that a certain interval of time has elapsed subsequent to start of transmission of a set of data from the keyboard 13 to the input b and prior to movement of the bolt 6 to the retracted position, the microprocessor automatically sets the motor 11 in operation to scramble the tumblers 4 even if the input b has received the predetermined set of data. This ensures that the bolt 6 can be moved to retracted position only within a certain period of time following the start of manipulation of the keyboard 13. Such programming constitutes an additional safety feature which is important under certain circumstances. For example, an authorized person who has caused the keyboard 13 to transmit a predetermined set of data to the microprocessor 12 (so that the bolt 6 can be retracted in response to depression of the knob of the actuator 15 and subsequent rotation of the shaft 2 in the direction of arrow Pfl) might have been disturbed subsequent to completed movement of tumblers 4 to the positions of FIG. 5 but prior to retraction of the bolt 6. The same procedure can be followed (i.e., the microprocessor 12 can cause the motor 11 to scramble the tumblers 4) if an authorized person has proceeded to transmit signals constituting the predetermined set of data in proper sequence but has failed to complete the transmission of a complete set of signals; the motor 11 then simply changes the angular position or positions of one or more tumblers 4 when the timer 112 transmits a signal denoting that the preselected interval of time (following the start of transmission of signals from the keyboard 13 to the microprocessor 12) has elapsed.

The manner of programming a microprocessor or an equivalent information storing component so that the output of the microprocessor transmits a signal or a series of signals to a motor or the like only when the input or inputs of the microprocessor receive a predetermined set of data is well known in the art and need not be described here. The microprocessor 12 is or can be programmed by way of the keyboard 13.

An important advantage of the improved combination lock is that the bolt 6 is ready for retraction within a small fraction of the time which elapses if the tumblers 4 are to be moved exclusively by hand. Moreover, the microprocessor 12 or an equivalent programmable unit can cause the motor 11 to perform a series of operations in addition to those which are needed to establish those circumstances under which the bolt 6 can be moved from extended to retracted position. Thus, and as already described above, the microprocessor 12 can also cause the motor 11 to actually retract the bolt 6, to return the bolt to the extended position, to prevent retraction of the bolt if the transmission of the predetermined set of data is not completed within a preselected interval of time or if the bolt is not retracted within a given period of time following unscrambling of the tumblers, and/or to scramble the tumblers in automatic response to return movement of the bolt to extended position and/or in automatic response to failure of the motor 11 or actuator 15 to retract the bolt within a preselected period of time following unscrambling of all of the tumblers.

The improved combination lock renders it possible to accomplish several objects which, at a first glance, would appear to be mutually exclusive or contradictory. Thus, the likelihood of rotation of the driver 2, 3 in directions and through angles which do not result in movement of all tumblers 4 to the positions of FIG. 5 is greatly reduced and is practically nil irrespective of the complexity of the selected combination and the number of tumblers, i.e., even if the number of tumblers is very large and the shaft 2 must be turned back and forth a large number of times. The only possible way of preventing the processor 12 from starting the motor 11 is to transmit to the processor an improper set of data as a result of oversight on the part of an authorized person or as a result of inaccurate guess by an unauthorized person, or by delaying the transmission of a requisite number of signals to the input a of the processor 12 so that the timer 112 responds and induces the processor to disregard all theretofore transmitted signals to the input b. The properly programmed processor 12 takes over as soon as its input b receives a proper series of data within the prescribed interval of time to initiate the operation of the motor 11 through predetermined angles and in predetermined directions which are necessary to align the notches 5 of all four tumblers 4 and to thus enable the link 7 to retract the bolt 6 in response to renewed rotation of the shaft 2, either by the actuator 15 or by the motor 11 (in response to a further signal from the processor 12).

Since the driver 2, 3 is rotated by an electric motor 11 (instead of being rotated by hand as in heretofore known combination locks), the owner of the lock can select a very complex combination which must be followed in order to permit retraction of the locking bolt 6 from its extended position. Thus, the owner can select a four-digit or a five-digit number, or a complex combination of letters and/or other symbols, without unduly prolonging that interval of time which is required by the motor 11 to complete repeated rotation of the shaft 2 in clockwise and counterclockwise directions through angles of predetermined magnitude in order to move the tumblers 4 to the angular positions of FIG. 5. The likelihood that an unauthorized person will be in a position to open the improved combination lock is greatly reduced by selecting a rather complex combination, e.g., a number which consists of at least three digits.

The utilization of a signal supplying device which employs a reader of encoded information in lieu of the keyboard 13 exhibits the advantage that an authorized person need not memorize the combination. All that is necessary is to use a card which contains the encoded information. The card can be inserted into a slot of the reader which replaces the keyboard 13 (or is used in addition to the keyboard) and such reader is equipped with electrooptical, magnetic or other suitable decoding means for the information on the card. Cards with embossed information and/or with information in the form of magnetic strips are well known and are in widespread use so that an authorized person possessing a card need not be taught how to use the card in order to induce the reader to transmit appropriate information to the processor 12 or to another suitable memory for the purpose of starting the motor 11. The utilization of a reader and a card in lieu of the keyboard 13 exhibits the advantage that an unauthorized person is even less likely to learn the combination because the person in charge of transmitting a set of predetermined data to the processor 12 need not influence a certain number of keys 13*a* in a predetermined sequence which could be observed and memorized or recorded by an unauthorized person.

If desired, and in order to ensure that the bolt 6 will be retracted within the interval which is determined by setting of the preferably adjustable timer 112, the improved combination lock 1 can be provided with or installed next to a suitable alarm which transmits one or more visible and/or audible signals when the movements of the cam 3 and of the tumblers 4 to the positions of FIG. 5 are completed. This informs the person in charge that she or he must depress and turn the actuator 15 in order to move the bolt 6 to the retracted position prior to automatic scrambling of the tumblers by the motor 11 in response to a signal from the timer 112. Of course, the alarm is not needed if the shaft 2 is to be rotated exclusively by the motor 11, also for the purpose of moving the bolt 6 between its extended and retracted positions and if the processor 12 is programmed to start the motor for the purpose of retracting the bolt 6 prior to expiration of the interval which is determined by setting of the timer 112.

The monitoring means 106 or another suitable monitoring device (e.g., the monitoring device 14, 14*a*) can be designed to monitor the movements of the locking bolt 6 back to its fully extended position and to initiate a scrambling of the tumblers 4 as soon as the movement of the bolt to its fully extended position is completed. For example, the disc 14 can be provided with a control track which forms part of the means for ascertaining whether or not the bolt 6 has reassumed its fully extended position. Return movement of the bolt 6 to fully extended position can trigger a scrambling of the tumblers 4 in order to further enhance the security and reliability of the lock. If the scrambling is to be carried out by hand (e.g., by way of the actuator 15), the device which monitors the position of the bolt 6 can be designed to initiate the generation of a visible and/or audible signal so that the person in charge is warned to scramble the tumblers following a movement of the locking bolt to the fully extended position. If the scrambling is performed by the motor 11, the microprocessor 12 receives a signal in response to completed movement of the bolt 6 to its fully extended position so that the motor 11 is started for the purpose of moving one or more tumblers 4 from the positions corresponding to those shown in FIG. 5. Scrambling of the tumblers 4 by way of the motor 11 can involve one or more full or partial revolutions of the shaft 2 in a clockwise and/or counterclockwise direction.

U.S. Pat. No. 4,433,563 to Wilson discloses a lock decoder which employs a microprocessor with a keyboard input. The patented decoder is a discrete apparatus which is put to use only when the opening combination of a safe lock or another combination lock has been lost or is not recalled by the person or persons who are authorized to open the lock. The lock decoder of Wilson employs an electric motor which can be coupled to a manually operable knob for the tumblers of the combination lock. The motor is operated in response to signals from the microprocessor which can cause the motor to turn the knob in accordance with each of a series of different combinations, and the microprocessor memorizes that combination which has enabled the knob to move all tumblers to predetermined positions permitting the locking bolt or hasp to move from the extended to the retracted position. An attempt is made to retract the locking bolt after each manipulation of the knob via motor in accordance with a particular combination. This is a tedious operation which is time-consuming in spite of the fact that the knob is rotated by a motor. It can be said that the patented lock decoder constitutes a means for solving the combination which, as a rule, should remain secret to all but a small group of persons who are authorized to open and close the combination lock. Moreover, and in contrast to the operation of the microprocessor in the patented lock decoder of Wilson, the processor 12 which is used in and can be considered a permanent component part of the improved combination lock is preferably designed to prevent further rotation of the shaft 2 and cam 3, or to initiate rotation of the shaft 2 in a sense to scramble the tumblers 4, whenever an attempt to align the notches 5 of all tumblers 4 is unsuccessful. On the other hand, Wilson employs a microprocessor which is programmed to automatically initiate a new sequence of rotations of the knob of a standard combination lock if the preceding sequence failed to result in movement of tumblers to positions in which the locking bolt can be retracted.

Certain individual elements of the improved combination lock are disclosed in published German patent application No. 36 21 564 of Igaki et al., in German Pat. No. 33 24 176 to Inoue, in published German patent application No. 37 11 501 of Raible, in published German patent application No. 30 33 233 of Stösser et al., in published German patent application No. 28 51 396 of Aydin and in U.S. Pat. No. 3,812,403 of Gartner. The application of Igaki et al. discloses an optical encoder which can be used in an electronic typewriter to indicate the position and/or the speed of a carriage. German patent to Inoue discloses a magnetic encoding device which can be used to monitor angular and/or linear displacements of moving parts, particularly in a machine tool. The application of Raible discloses a lock wherein a rotary knob on an outer shell of the lock can be connected to a confined rotary member by an electromechanical coupling device which can be actuated by a reader in response to insertion of a specially designed card. The application of Stösser et al. discloses an electronically operated lock with an electronic eraser if the intervals between successive signals which must be transmitted to a control unit are too long. This publication further discloses the possibility of employing a portable energy source for the current-consuming components of the lock. The application of Aydin discloses an electronic lock which employs a key in the form of a card. The disclosure of this application and of the corresponding U.S. Pat. No. 4,177,657 is incorporated herein by reference for the description of a card and a card reader which can be used in lieu of the keyboard 13 as a means for transmitting to the processor 12 a predetermined set of data in order to cause the motor 11 to proceed with rotation of the driver 2, 3 in a sense to move the tumblers 4 to the positions of FIG. 5. The patent to Gartner discloses a manually operated electronic combination lock with means for displaying generated signals to facilitate the manipulation of a manually operated switch.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A combination lock comprising a plurality of tumblers movable with reference to each other to and from predetermined positions; a locking bolt movable between extended and retracted positions in the predetermined positions of said tumblers; a motor forming part of the combination lock, connected with said tumblers and operable to move said tumblers to said predetermined positions; and programmable means for operating said motor, said programmable means comprising a processor having at least one signal-transmitting output connected with said motor and at least one data-receiving input, and means for supplying to said input a plurality of sets of data including a predetermined set of non-storable data known to the operator of the combination lock and serving to initiate the transmission of at least one signal by way of said at least one output to operate said motor and to thereby move said tumblers to said predetermined positions.

2. The lock of claim 1, further comprising a rotary driver arranged to move said tumblers to and from said predetermined positions and receiving torque from said motor.

3. The lock of claim 1, wherein said data supplying means comprises a device which is actuatable by hand to select any one of said sets of data including said predetermined set of known data.

4. The lock of claim 1, wherein said processor is programmed to transmit to said motor said at least one signal only in response to reception of said predetermined set of known data and only in response to reception of a complete predetermined set of known data.

5. The lock of claim 1, wherein said processor is programmed to transmit to said motor said at least one signal only in response to reception of a complete predetermined set of known data within a predetermined interval of time.

6. The lock of claim 1, wherein said data supplying means comprises a keyboard.

7. The lock of claim 1, wherein said data supplying means comprises an indexible dial.

8. The lock of claim 1, further comprising means for monitoring the positions of said tumblers and for transmitting to said processor signals denoting the monitored positions of said tumblers.

9. The lock of claim 8, wherein each of said tumblers is further movable to a starting position and said monitoring means includes an optoelectronic sensor.

10. The lock of claim 8, further comprising a rotary driver arranged to move said tumblers about a predetermined axis and said monitoring means comprises an input member arranged to rotate in synchronism with said driver and a transducer arranged to transmit to said processor signals denoting the angular position of said driver.

11. The lock of claim 10, wherein said input member comprises a disc or a gear and said transducer comprises an inductive signal transmitter.

12. The lock of claim 1, further comprising a casing for said data supplying means, said motor being connected to said casing.

13. The lock of claim 1, further comprising a rotary driver for said tumblers, said motor including an electric motor having an output element directly connected with or including said driver.

14. The lock of claim 13, wherein said motor is a stepping motor.

15. The lock of claim 1, further comprising a rotary driver for said tumblers, said motor including an electric motor having an output element directly connected with or including said driver.

16. The lock of claim 1, further comprising a rotary driver for said tumblers and means for transmitting torque from said motor to said driver.

17. The lock of claim 1, wherein said motor has a rotary output element and further comprising detector means for monitoring the positions of said tumblers and for transmitting to said programmable means signals denoting the positions of said tumblers, said detector means including an input member on said output element.

18. The lock of claim 1, further comprising a rotary driver for said tumblers, said driver being rotatable by said motor and further comprising means for rotating said driver independently of said motor.

19. The lock of claim 18, wherein said rotating means comprises a manually rotatable actuator and a disengageable clutch between said actuator and said driver.

20. The lock of claim 19, wherein said clutch comprises a first clutch element on said driver and a complementary second clutch element on said actuator, said actuator being movable axially between a first position in which said second clutch element engages said first clutch element and a second position in which said second clutch element is disengaged from said first clutch element.

21. The lock of claim 20, further comprising means for yieldably biasing said actuator to said second position.

22. The lock of claim 18, wherein said rotating means includes a manually rotatable actuator and a slip clutch between said actuator and said driver.

23. The lock of claim 18, wherein said rotating means comprises a manually rotatable actuator and a free-wheel between said actuator and said driver.

24. The lock of claim 1, wherein said predetermined set of known data includes a set of discrete data, said data supplying means including means for furnishing information denoting the completion of transmission of said discrete data of said predetermined set of known data.

25. The lock of claim 1, wherein said data supplying means comprises a reader of information arranged to initiate the transmission of said at least one signal in response to presentation of predetermined information which is stored on a carrier, such as a card.

26. The lock of claim 1, further comprising detector means for monitoring said tumblers and for generating a signal in response to detection of movement of all of said tumblers to the respective predetermined positions.

27. The lock of claim 1, further comprising a rotary driver for said tumblers, said driver receiving motion from said motor and further comprising detector means for monitoring the positions of said tumblers and for transmitting to said programmable means signals denoting the monitored positions of said tumblers, and means for generating signals in response to movement of said bolt to at least one of said extended and retracted positions thereof.

28. The lock of claim 1, wherein said operating means comprises a microprocessor which is programmed to operate said motor in response to movement of said bolt to extended position in order to move at least one of said tumblers from the respective predetermined position.

29. The lock of claim 1, wherein said tumblers are rotatable to said positions thereof and further comprising an actuator which is movable by hand to rotate said tumblers independently of said motor.

30. The lock of claim 29, wherein said actuator includes a rotary knob and further comprising means for indicating the angular positions of said knob.

31. The lock of claim 1, further comprising an actuator arranged to move said tumblers independently of said motor, said data supplying means being provided on said actuator.

32. The lock of claim 1, further comprising sensor means for monitoring the position of said bolt and for generating signals denoting the monitored position of said bolt, said programmable means including means for starting said motor to move at least one of said tumblers from the respective predetermined position within a preselected interval of time following the operation of said motor when the signals from said sensor means indicate that the bolt remains in said extended position during said interval.

33. The lock of claim 32, wherein said processor includes a microprocessor and said starting means comprises a timer which is embodied in or is connected with said microprocessor.

* * * * *